United States Patent [19]

Bishop et al.

[11] 3,960,990

[45] June 1, 1976

[54] CARBURETOR POWER VALVE CONTROL APPARATUS

[75] Inventors: Gerald B. Bishop, Dearborn; David J. Gladden, Garden City, both of Mich.

[73] Assignee: Ford Motor Company, Dearborn, Mich.

[22] Filed: Aug. 5, 1974

[21] Appl. No.: 490,161

[52] U.S. Cl. ..... 261/39 A; 261/69 R; 261/121 B

[51] Int. Cl.[2] ..... F02M 1/10

[58] Field of Search ..... 261/69 R, 39 A, 121 B, 261/34 B

[56] References Cited

UNITED STATES PATENTS

| | | | |
|---|---|---|---|
| 1,981,969 | 11/1934 | Prentiss | 261/34 B |
| 2,879,047 | 3/1959 | Wagner | 261/34 B |
| 3,011,770 | 12/1961 | Stoltman | 261/69 R |
| 3,059,909 | 10/1962 | Wise | 261/39 D |
| 3,077,341 | 2/1963 | Schlichting | 261/DIG. 38 |
| 3,531,094 | 9/1970 | Andrew | 261/69 R |
| 3,706,444 | 12/1972 | Masaki et al. | 261/39 D |
| 3,872,190 | 3/1975 | Brown et al. | 261/69 R |

*Primary Examiner*—Tim R. Miles
*Assistant Examiner*—Gregory N. Clements
*Attorney, Agent, or Firm*—John J. Roethel; Keith L. Zerschling

[57] ABSTRACT

Carburetor power valve control apparatus for an internal combustion engine. The control apparatus includes a vacuum motor and temperature sensitive power means. The power means opens and closes a vacuum bleed port in communication with the vacuum motor so that under cold operating conditions the power valve opens at a greater actual intake manifold vacuum than under warm operating temperatures. This results in earlier power valve opening at cold engine temperatures which improves drivability and allows balancing of all carburetor fuel systems to achieve improved fuel economy and reduced engine emissions.

1 Claim, 3 Drawing Figures

CARBURETOR POWER VALVE CONTROL APPARATUS

BACKGROUND AND SUMMARY OF THE INVENTION

The power fuel supply system of an internal combustion engine carburetor supplies additional fuel to the induction passages resulting in a richer mixture required for increased power during vehicle acceleration or any time there is a heavy loading of the engine. One known type of power valve system is operated by intake manifold vacuum acting on a small piston or diaphragm. The piston actuates the power valve when the vacuum decreases during heavy loading or acceleration of the engine.

It has been found that improved drivability and economy and more precise control over engine emissions can be achieved by providing means which open the power valve in response to both intake manifold vacuum and intake air temperature. It is also an object of this invention to provide a power fuel supply system that is employed earlier (at a lesser vacuum decay) when the engine is cold than when it is warmed. Further, this invention provides a power valve control means that is adjustable to vary the relative power valve opening times of cold versus warm engines. Finally, it is an object of this invention to provide a power valve as described above which may be incorporated in carburetors of existing designs without major structural modifications.

Power valve control apparatus constructed in accordance with this invention includes a vacuum motor which displaces the movable element of an internal combustion engine carburetor power valve in response to changes in intake manifold vacuum. The vacuum passage interconnecting the vacuum motor and the source of intake manifold vacuum includes a temperature sensitive valve which opens in response to changes in induction air temperatures to bleed or vent the vacuum passage to the atmosphere.

DETAILED DESCRIPTION OF A PREFERRED EMBODIMENT

Figure 2:
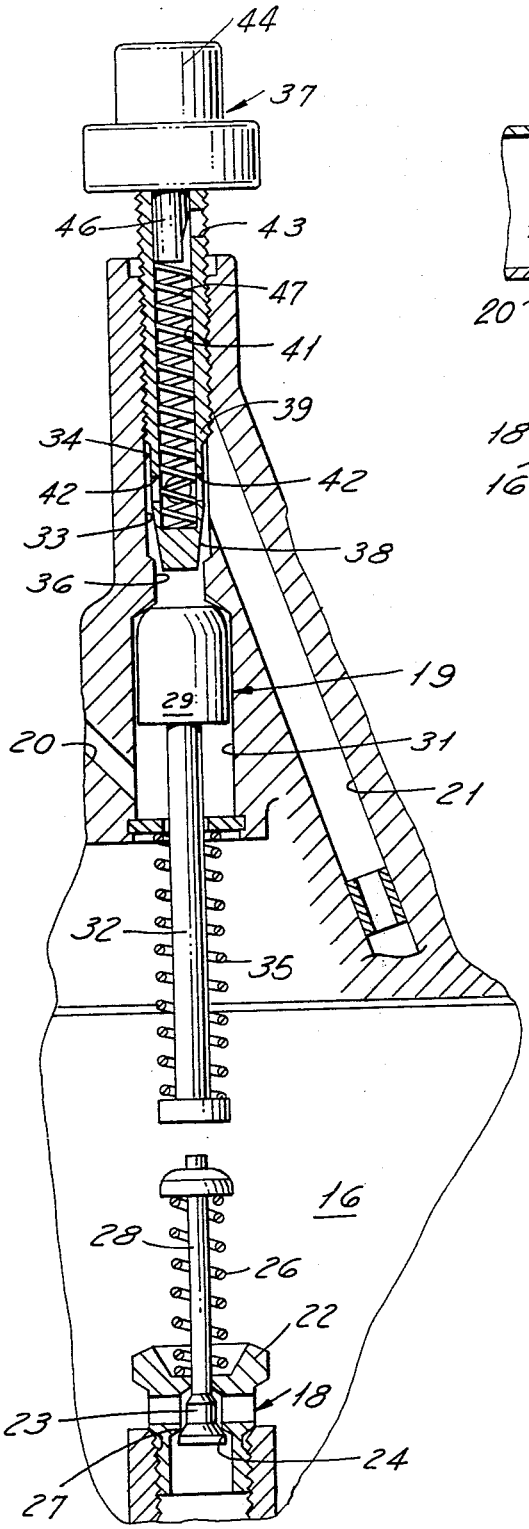
FIG. 2 is an enlarged cross sectional view of the power valve and the power valve control apparatus of FIG. 1.
Figure 1:
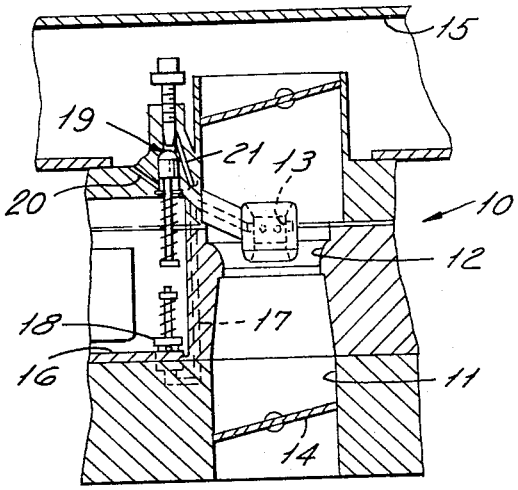
FIG. 1 is a cross sectional view of a portion of an internal combustion engine carburetor and air cleaner illustrating the environment of the invention.

A portion 10 of an internal combustion engine carburetor has an induction passage 11 including a main venturi 12 and a booster venturi 13. A throttle plate 14 is pivotally positioned downstream of the venturis. A fuel bowl 16 is connected to the induction passage by means of passage 17. A power valve assembly 18 opens and closes the entry to the passage 17 from the fuel bowl. The valve assembly 18 is operated by a vacuum motor assembly 19 connected to a source of intake manifold vacuum downstream of throttle plate 14 by a passage 21.

The power valve includes a fitting 22 threadedly received in the base of the fuel bowl 16. A movable element 23 is slidably received within an orifice 24 formed in the fitting and is biased by a coil spring 26 toward a closed position as shown in FIG. 2. In the closed position, conical surface 27 of the movable element engages the edge of inlet orifice 24 to provide the closure between the fuel passage 17 and the fuel bowl 16. The movable element 23 includes a portion 28 that extends upwardly toward the vacuum motor 19.

The vacuum motor assembly 19 includes a piston member 29 slidably received within a bore 31 formed in the carburetor housing. The piston is undersize relative to bore 31 as shown in FIG. 2 to permit restricted flow of air through the bore past the piston. Passage 20 draws air at substantially atmospheric pressure from the interior of the air cleaner 15. Restricted air flow about or through the piston may be provided by means other than about the piston 29. For example, a passage through the piston or a notch or groove in the outer surface of the piston may be formed to permit air flow through or past the piston.

The piston member 29 includes a downwardly extending stem portion 32 which engages the end of upwardly extending portion 28 and opens the power valve 18 when the piston member is in lowered position within the bore 31. A compression spring 35 is positioned about stem portion 32 and biases the piston downwardly. The upper side of the piston is in communication with a source of intake manifold vacuum by means of passages 33 and 21. Passage 33 includes a partially threaded bore 34 extending vertically upwardly from the piston. The bore is separated from the piston by a reduced diameter portion 36.

Threadedly received within the bore is a thermostatic valve assembly 37. The thermostatic assembly includes a shank 39 having a conical end tip 38 which is received within the reduced diameter portion 36 to provide a restricted orifice or throttling valve. The thermostatic assembly is rotated within the threaded bore to move the tip 38 axially relative to the reduced diameter portion 36 and, thus, to vary the restriction or effective area between portion 36 and bore 34. The shank 39 includes an axially extending bore 41 opening to the bore 34 at its lower end through radially directed holes 42 and to the interior of the air cleaner through port 43. The upper portion 44 of the assembly 37 is a wax pellet motor having a plunger or movable element 46 slidably received within bore 41. When fully protracted the plunger 46 blocks port 43. When the plunger is fully retracted the port 43 is open. A coil spring 47 is received within the bore 41 and urges the plunger 46 toward its open position.

OPERATION

When the intake air entering the air cleaner is warm, the plunger 46 of the thermostatic valve assembly 37 is protracted and the port 43 is closed. When the engine is idling, the intake manifold vacuum is high and the pressure differential acting on piston 29 is greater than the force of spring 35. Consequently, the piston is in its fully raised position and the power valve 18 is closed. As the throttle valve 14 opens, the intake manifold vacuum decreases. At a predetermined magnitude of decreased vacuum, the force of spring 35 equals the force resulting from the pressure differential acting on piston 29 and further opening of the throttle valve will result in the piston moving downwardly and the power valve 18 being opened. This operation is typical of similar known power valve apparatus.

The invention provides for earlier opening (at a point of less vacuum decay) of the power valve when the induction air temperatures are cold. In such a case, the plunger 46 of the thermostatic valve assembly 37 is retracted to fully or partially open the port 43. Consequently, the vacuum signal to the vacuum motor is reduced because air from the air cleaner 15 at more nearly atmospheric pressure is drawn into the vacuum passages. It can thus be seen that a lesser intake manifold vacuum decay is required to reach the point at which the vacuum signal pressure differential on the piston 29 is overcome by the force of spring 35. The power fuel system acts earlier when the engine is cold than when it is warmed. This results in improved cold drivability.

The apparatus shown in the drawings and described above includes an adjustment means by which the opening points of the power valve 18 may be varied. The apparatus includes a throttling valve formed by reduced diameter portion 36 above the piston 29 and the conical tip 38 of the thermostatic valve assembly 37. The piston fits loosely within the bore 31 so that a restricted passage of air about the piston is permitted. The volume beneath the piston is connected to the interior of the air cleaner 15 by passage 20. It may be seen that air at substantially atmospheric pressure can be drawn into the vacuum system by two means: (1) through the port 43, down bore 41 into bore 33, and (2) through passage 20 into bore 31 and past piston 29. The air flow through passage 20 is greater by design than the air flow through port 43. Rotation of the shank 39 of thermostatic valve assembly within the threaded portion of bore 34 results in increasing or decreasing the opening between tip 38 and reduced diameter portion 36. An increase in the effective area of the opening results in the vacuum motor 19 being increasingly responsive to the intake manifold vacuum. This is equivalent to saying that an increase in the area of the opening results in retarding the opening time of the power valve 18 or, alternatively, requires a greater vacuum decay upon acceleration or loading to actuate the power fuel system.

Figure 3:
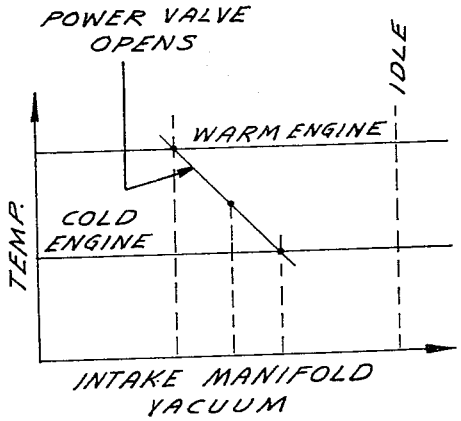

FIG. 3 is a graphical representation of power valve opening as a function of intake air temperature and intake manifold vacuum. It can be seen that less of a vacuum decay is required to open the power valve at cold engine or cold intake air temperatures than at warm engine temperatures.

Modifications and alterations can occur to those skilled in the art which are included within the scope of the following claims:

We claim:

1. Power valve control apparatus for a carburetor having an induction passage, a fuel bowl, fuel passage means interconnecting said fuel bowl and said induction passage, an air cleaner positioned on said carburetor over said induction passage, power valve means opening into said fuel passage from said fuel bowl, said power valve means having an element movable to open and close said fuel passage, a vacuum motor for displacing said movable element in response to changes in intake manifold vacuum, said vacuum motor comprising a first bore formed in the carburetor housing, a piston slidably received within said first bore, said piston having one side subject to a vacuum signal and the other side subject to more nearly atmospheric pressure, said piston being constructed to permit air flow from the atmospheric side of the piston to the vacuum side, said piston including an element extending into said fuel bowl and being engageable with the movable element of said power valve means, a variable volume chamber within said first bore on one side of said piston, a second bore axially aligned with said first bore leading from said chamber, said second bore and said first bore separated by a reduced diameter portion, a thermostatic valve assembly including a stem portion received within said second bore, the end of said stem portion being tapered and received within said reduced diameter portion, said stem portion being axially displaceable relative to said reduced diameter portion to vary the effective opening between said first bore and said second bore, an air bleed passage axially formed within said stem portion in communication with said second bore, a port formed in said stem portion communicating the air bleed passage and the interior of the air cleaner, said port, air bleed passage and bore communicating said chamber with the interior of said air cleaner, said valve assembly including a temperature sensitive power means having a movable element axially slidable within said air bleed passage to progressively open and close said port in response to changes in air temperature within the air cleaner.

* * * * *